US006247675B1

(12) United States Patent
Askin

(10) Patent No.: US 6,247,675 B1
(45) Date of Patent: Jun. 19, 2001

(54) DISPLAY HANGER FOR A DOG LEASH

(75) Inventor: Barry Askin, Mount Sinai, NY (US)

(73) Assignee: Four Paws Products, Ltd., Hauppauge, NY (US)

( * ) Notice: Subject to any disclaimer, the term of this patent is extended or adjusted under 35 U.S.C. 154(b) by 0 days.

(21) Appl. No.: 09/314,473

(22) Filed: May 18, 1999

(51) Int. Cl.[7] ..... A47B 96/06

(52) U.S. Cl. ..... 248/214; 248/215; 248/305; 224/268; 211/70.6; 206/377

(58) Field of Search ..... 248/214, 215, 248/305, 339, 340; 224/268, 272, 270, 913; 211/70.6, 60.1; 206/377, 349, 493, 463, 462

(56) References Cited

U.S. PATENT DOCUMENTS

| | | | | |
|---|---|---|---|---|
| D. 299,003 | * | 12/1988 | Fadeeley, Jr. | D8/367 |
| D. 308,628 | * | 6/1990 | Sorlien et al. | D8/356 |
| D. 326,405 | * | 5/1992 | Leto | D8/367 |
| D. 328,416 | * | 8/1992 | Karrer et al. | D8/367 |
| D. 389,728 | * | 1/1998 | Fitzwater | D8/367 |
| D. 395,454 | * | 6/1998 | Crim, Jr. | D3/218 |
| 928,006 | * | 7/1909 | Thomas | 24/232 |
| 2,841,289 | * | 7/1958 | Odlum et al. | 211/87 |
| 3,123,331 | | 3/1964 | Field et al. | 248/317 |
| 3,710,996 | | 1/1973 | Smilow et al. | 223/87 |
| 4,063,669 | | 12/1977 | Smilow et al. | 223/87 |
| 4,729,473 | * | 3/1988 | Kulzer et al. | 206/477 |
| 4,903,922 | * | 2/1990 | Harris, III | 248/75 |
| 4,977,860 | * | 12/1990 | Harwell | 119/109 |
| 5,695,161 | * | 12/1997 | Brozak, Jr. | 248/215 |
| 5,864,927 | | 2/1999 | Liu | 24/163 R |
| 5,967,340 | * | 10/1999 | Kao | 211/70.6 |

* cited by examiner

*Primary Examiner*—Ramon O Ramirez
*Assistant Examiner*—Kimberly Wood
(74) *Attorney, Agent, or Firm*—Darby & Darby

(57) ABSTRACT

A hanger for displaying a leash, including a main body with a horizontal hook for engaging a spring latch of the leash and a vertical hook for engaging a loop handle of the leash. The vertical hook is connected to said main body and includes a second support arm having a first end in connection with said main body and a second end opposite said first end, said second support arm located approximately along the vertical plane and constructed to support the spring latch, said second hook further includes one or more extension arms connecting said second end to said main body so that said vertical hook forms a loop with said main body; and wherein one of said one or more extension arms includes a slot such that the latch can engage said second support arm by entering the loop through the slot.

1 Claim, 1 Drawing Sheet

DISPLAY HANGER FOR A DOG LEASH

FIELD OF THE INVENTION

This invention relates to a hanger for displaying a leash of the type commonly used for animals.

BACKGROUND OF THE INVENTION

The present invention relates to a hanger for displaying a leash, and more particularly to a hanger designed to engage two parts of the leash, namely, the spring latch and the leash handle. Due to their length, dog leashes are generally displayed folded in half. In addition, some known display hangers engage the dog leash by a plastic fastener or other attachment secured to the leash. The fastener also serves to secure the dog leash in its folded orientation. One disadvantage of this arrangement is that use of the hanger requires that the dog leash include a fastener or attachment. Another disadvantage is that the fastener prevents the full dog leash from being inspected by a potential purchaser.

Therefore, there is a need for a display hanger which engages the dog leash itself, rather than a fastener secured to the dog leash. There is a further need for a display hanger which can be readily disengaged from the dog leash so that the dog leash can be inspected by a potential purchaser.

SUMMARY OF THE INVENTION

According to one embodiment of my invention, a display hanger includes a main body designed to engage two parts of a leash, namely, the spring latch and the loop portion of the leash handle. The main body can be made from a unitary piece of plastic and includes first and second protruding hooks. The first hook includes an extension arm and a first support arm connected to the extension arm. Where the main body has a top and a bottom oriented in a vertical plane, the first support arm is oriented in a horizontal plane such that it can support the loop of the leash handle. The second protruding hook includes a second support arm which can be shaped in an angular form with a nadir. The second support arm is oriented in the vertical plane such that it can support the spring latch of the leash at the nadir.

DETAILED DESCRIPTION OF AN ILLUSTRATIVE EMBODIMENT

Figure 1:
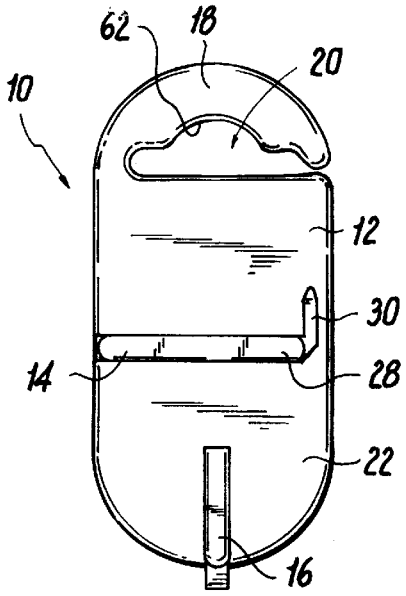
FIG. 1 is a front view of a hanger according to an embodiment of my invention.
Figure 2:
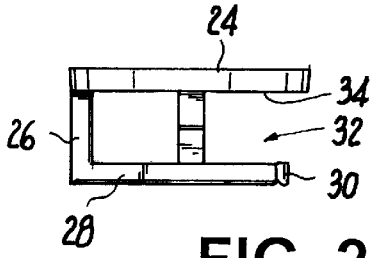
FIG. 2 is a top view of the FIG. 1 hanger.
Figure 3:
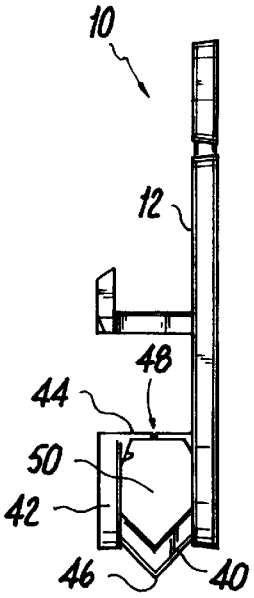
FIG. 3 is a side view of the FIG. 1 hanger.

In accordance with the invention, the hanger shown in the FIGS. 1 to 4 and generally indicated by reference number 10 comprises broadly: a main body element 12, a protruding horizontal hook 14, a protruding vertical hook 16, an engagement hook 18 and a shaped recess 20. The hanger 10 can be formed as a unitary molding from any flexible material having a degree of resilience, such as, for example, plastic or a larger variety of materials having similar properties. The main body element 12 further includes a front surface 22 and a rear surface 24 (FIG. 2). The hook 14 includes an extension arm 26, a support arm 28 and a containment arm 30. The extension arm 26 protrudes from the front surface 22 of the main body element 12 and extends along the z axis (the x, y and z axes are shown in FIG. 1). The support arm 28 extends along the x axis or horizontal plane from a connection to arm 26 and the containment arm 30 extends along the y axis or vertical plane from a connection to arm 28. Due to the extension arm 26, the support and containment arms 28 and 30 are located at a distance from the front surface 22 of the main body element 12. As a result, there is a space 32 between arm 28 and front surface 22. In addition, since the containment arm 30 does not connect to the front surface 22, there is a gap 34 between arm 30 and surface 22. The space 32 is accessible by the gap 34. When the device 10 is in use, it is oriented as shown in FIG. 1 with the support arm 28 located along the x axis. As a result, the support arm 28 can accommodate a load hung around it by overcoming the containment arm 30.

The hook 16 includes a support arm 40, a first containment arm 42 and a second containment arm 44. The support arm 40 protrudes from the main body element 12 at the front surface 22 along the z axis. The support arm 40 has an angular shape, such that it includes a point 46. The first containment arm 42 extends along the y axis from a connection to the support arm 40. The second containment arm 44 extends along the z axis from a connection to the first containment arm 42 and contacts the front surface 22. The arm 44 includes a slot 48 which is approximately centrally located on the arm 44. The arms 40, 42 and 44 and front surface 22 define an enclosed space 50. When the hanger 10 is in use as oriented in FIG. 1, a load which is applied to the hook 16 can be supported by point 46 of the support arm 40.

The engagement hook 18 is semi-circular and overlies correspondingly shaped space 20. The space 20 includes a peak 62. It permits the hanger 10 to be engaged on a display rod 70 (FIG. 4) or other similar display device. In use, the hanger 10 is placed on such display rod 70 so that the rod 70 is located in the space 60. Due to the shape of the space 60, rod 70 can rest at the peak 62.

Figure 4:
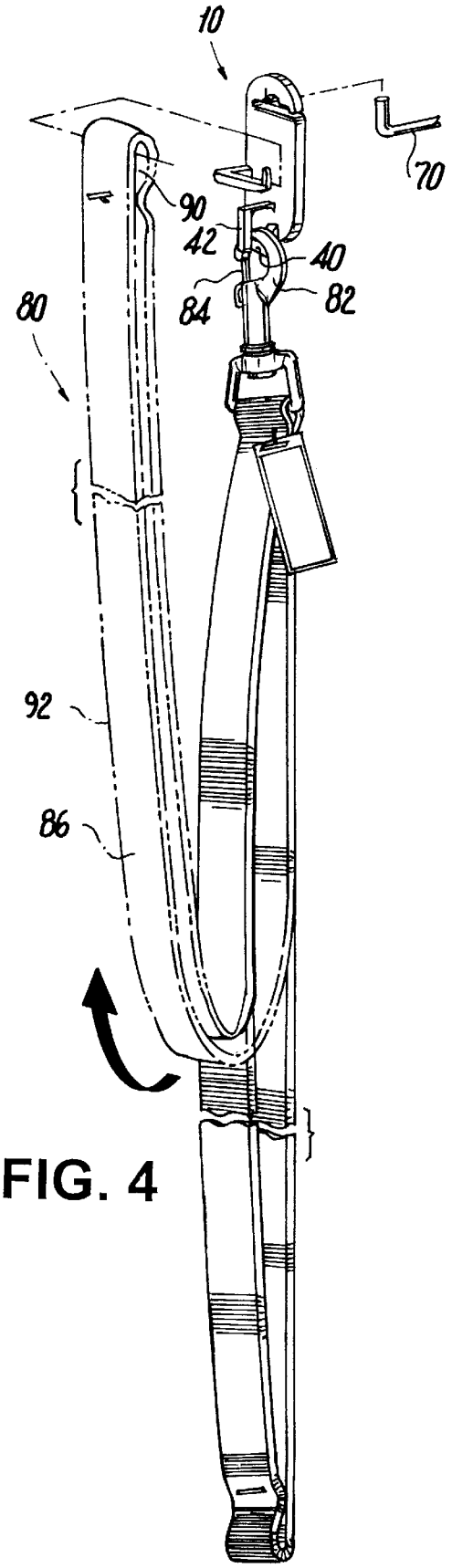
FIG. 4 is a perspective view of the FIG. 1 hanger including a display rod and a dog leash for engagement with the hanger.

Referring to FIG. 4, there is shown the hanger 10 engaging a dog leash 80. The dog leash 80 includes the following components: a swivel hook 82, a spring latch 84, a leash main body 86 and a leash handle 88. The support arm 40 of the hook 16 is adapted to accommodate the spring latch 84. The latch 84 rests on point 48 of the support arm 40. The support arm 28 of hook 14 can accommodate the leash handle 88. The leash handle 88 includes a loop 90 resulting from the main leash body 86 being folded to form two plies. The loop 90 can be inserted over the containment arm 30 and onto the support arm 28. Once installed, the containment arm 30 prevents loop 90 of the leash handle 88 from slipping off the arm 28.

The dog leash 80 can be installed onto the hanger 10 by first installing the spring latch 84 onto the hook 16 followed by bending the main leash body 86 so that the loop 90 is adjacent to the hook 14. The loop 90 can be pulled over the containment arm 30 to rest on the support arm 28.

Once installed, two portions of the leash 80, namely, the spring latch 84 and the loop 90, are conveniently secured to a single display component, hanger 10. In addition, as displayed, the main leash body 86 can be reduced in length by approximately one half. As a result, while the leash 80 is folded in half for display, the hanger 10 is constructed to engage the leash 80 itself rather than a fastener or other attachment to the leash 80. Moreover, potential purchasers can readily remove and inspect the leash 80 from the hanger 10. In addition, where more than one hanger 10 with a leash 80 is placed on the rod 70, the leash handle 88 near the loop

90 contacts the rear surface 24 of the hanger 10 in front of it. In this way, a fabric portion of the leash 80 contacts adjacent hangers 10, thereby protecting the spring latch 84 from contact with a surface (i.e., rear surface 24) which can scratch it.

Moreover, in alternative embodiments of the hanger 10 according to the present invention, rather than the loop 90 engaging the support arm 28, the leash 88 can be folded at another point such as, for example, point 92. Point 92 can then be draped over the support arm 28 and, as a result, loop 90 dangles below the hanger 10. In this way, the leash 80 can be further compacted for an alternate display approach.

In further alternative embodiments according to the present invention, the hooks 14 and 16 can be reversed in location (not shown) on the front surface. In this embodiment, the spring latch 84 would be in view from the front of the display hanger 10 when the leash 80 is engaged rather than the leash main body 86. In still further embodiments, the hooks 14 and 16 can be side by side along the y axis of the hanger 1 shown in FIG. 1. Also, in alternative embodiments, one or both of the hooks 14 and 16 can be located on the rear surface 24. As is clear, the location of the hooks 14 and 16 on the hanger 10 does not limit the scope of my invention.

In additional embodiments according to the present invention, the containment arm 30 can be oriented in a variety of positions, including coming into movable contact with the front surface 22 (e.g., a clip etc.). Where the support arm 28 is available to support a load such as the leash loop 90, the hook 14 can be any configuration which has a gap to engage the loop 90 and any configuration of arms 26, 28 and 30 which provides access to the loop 90 of the support arm 28 as well as containment of such loop 90. Similarly, in additional embodiments according to the present invention, support arm 40 can be any shape which provides support for the spring latch, including, for example, a straight arm. Moreover, the first containment arm 42 need not connect to the second containment arm 44. The inclusion of the arm 44 itself is a design decision. In addition, the slot 48 is optional. Where the support arm 40 is available to support a load such as a leash spring latch 84, the hanger 10 can be any configuration of two or more arms (e.g., 40 and 42) which provide support for and containment of the latch 84.

In still further alternative embodiments according to the present invention, the hanger 10 can be modified for use as a storage device for the leash 80. For example, the shaped recess 20 can be eliminated and a backing material can be added to the rear surface 24 such that it adheres the hanger 10 to a wall. The hanger 10 can then be used to store a leash 80 when it is not in use.

While the embodiments of the invention shown and described are fully capable of achieving the results desired, it is to be understood that the embodiments have been shown and described for purposes of illustration only and not for purposes of limitation.

What is claimed:

1. A hanger for displaying a leash, the leash including a leash body, a spring latch and a leash handle, the leash handle being a folded over portion of the leash body such that the leash handle includes a loop, said hanger comprising:

a main body including a top and a bottom located along a vertical plane;

a first hook connected to said main body and including a first connecting arm connected to said main body and a first support arm in connection with said first connecting arm, said first support arm being located approximately along a horizontal plane and oriented to define a space between said main body and said first support arm, and constructed to support the loop of the leash handle; and a second hook connected to said main body and including a second support arm having a first end in connection with said main body and a second end opposite said first end, said second support arm located approximately along the vertical plane and constructed to support the spring latch, said second hook further including one or more extension arms connecting said second end to said main body so that said second hook forms a loop with said main body; and wherein one of said one or more extension arms includes a slot such that the latch can engage said second support arm by entering the loop through the slot.

* * * * *